United States Patent [19]

Greenleaf

[11] Patent Number: 4,768,732

[45] Date of Patent: Sep. 6, 1988

[54] MOBILE CABLE CARRIER CONVERTIBLE TO ROTARY DISPENSING REEL

[76] Inventor: Joseph M. Greenleaf, 2802 W. Marine View Dr., Everett, Wash. 98201

[21] Appl. No.: 129,293

[22] Filed: Dec. 7, 1987

[51] Int. Cl.[4] ..... B65H 49/00; B65H 75/40

[52] U.S. Cl. ..... 242/86.5 R; 242/129

[58] Field of Search ..... 242/86.2, 86.5 R, 86.52, 242/86.3, 86.7, 86.8, 129, 105, 130.2, 79, 82, 107.1–107.15, 132, 137, 139

[56] References Cited

U.S. PATENT DOCUMENTS

| | | | |
|---|---|---|---|
| 2,310,036 | 2/1943 | Owens | 242/86.5 R X |
| 2,500,116 | 3/1950 | Carter et al. | 242/129 |
| 3,107,878 | 10/1963 | Wong | 242/86.7 |
| 3,464,647 | 9/1969 | Jacobi | 242/129 |
| 3,863,859 | 2/1975 | Keith | 242/86.5 R X |
| 4,437,625 | 3/1984 | Van Sickle | 242/129 |

FOREIGN PATENT DOCUMENTS

| | | | |
|---|---|---|---|
| 11517 | of 1913 | United Kingdom | 242/129.5 |

*Primary Examiner*—John M. Jillions
*Attorney, Agent, or Firm*—Christopher Duffy

[57] ABSTRACT

The carrier has a foot which is suspended from the wheeled carriage of the same and lowered into engagement with a supporting surface therebelow. The foot and carriage are adapted to rotate in relation to one another, moreover, so that when the foot is so engaged, the carriage can be rotated about the foot on the wheels of the carriage. In this way, the carriage can be used as a rotary dispensing reel for the cable, as well as a mobile carrier for it.

12 Claims, 2 Drawing Sheets

Fig. 1
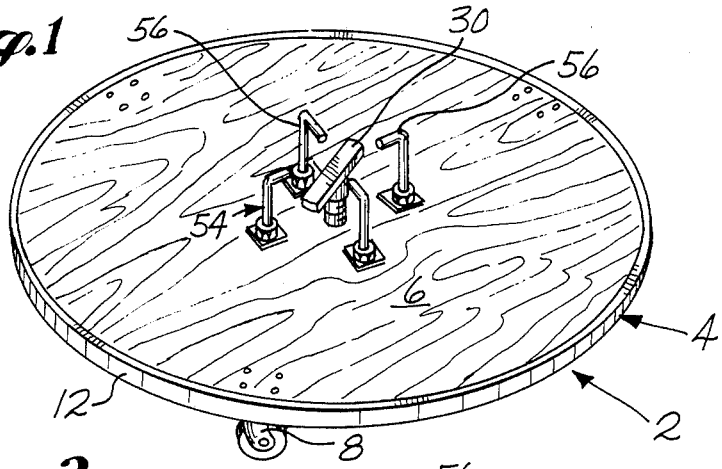
Fig. 3
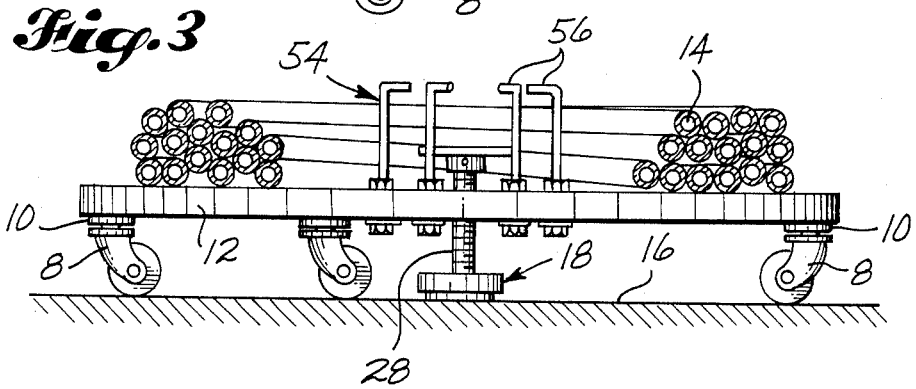
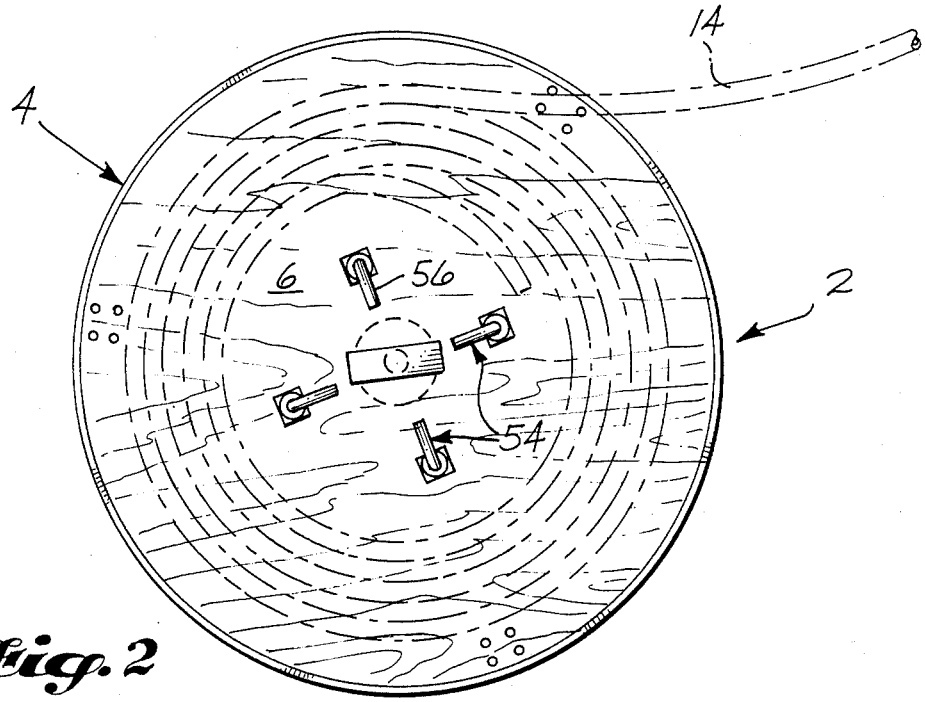
Fig. 2

MOBILE CABLE CARRIER CONVERTIBLE TO ROTARY DISPENSING REEL

TECHNICAL FIELD

This invention relates to a mobile carrier for electrical cable or the like, and in particular, to a mobile cable carrier which is capable of being rendered immobile and then used as an unwinder for the cable while the cable is being put to use, for example, in outfitting a new telephone exchange.

BACKGROUND ART

Mobile cable carriers are known, as are cable carriers which can be rendered immobile and then used as cable unwinders. See U.S. Pat No. 3,721,394, 4,184,647 and 1,825,214. However, cable carriers such as these have an on-board dispensing reel which is rotatable independently of the base or support by which the reel is rendered mobile. Therefore, the carrier is no sturdier and no less complicated than the mechanism by which the reel is rotatably mounted on the support. Also, the carrier is often top heavy in construction and/or unstable in location when the cable is being unwound from it, due to the fact that the base or support must not only be rendered immobile, but also stabilized against turning with the reel.

DISCLOSURE OF THE INVENTION

The present invention provides for using the base or support itself as a dispensing reel for the cable. According to the invention, the carrier comprises a carriage which is raised above a surface therebelow and supported on rotary surface engaging elements, so that it can be shifted in relation to the surface when desired, or rotated about a vertical axis therethrough on the elements. It also comprises a surface engaging foot which is interposed between the carriage and the surface on the aforesaid axis of the carriage. There are support means for moveably suspending the foot on the carrier so that the foot can be raised and lowered in relation to the surface on the axis, and drive means for raising and lowering the foot along the axis. There are also means on the carriage defining a raised hub about the axis thereof, which is adapted to have the cable or the like wound thereabout, and alternatively, unwound from the same when the cable is put to use. Meanwhile, the drive means and support means are rotatable in relation to the foot, and vice-versa, so that when the foot is engaged with the surface below the carriage, the carriage can be rotated about the axis thereof on the surface engaging elements of the same, to serve as an unwinder for the cable or the like.

In many of the presently preferred embodiments of the invention, the drive means include a jack which is rotatably mounted on the carriage above the foot and operable to raise and lower the foot relative to the surface. In some embodiments, the drive means also include actuator means which are connected with the jack and manually operable to cause the jack to raise and lower the foot relative to the surface. In some of these, moreover, the actuator means are positioned above the carriage, adjacent the axis of the same, and the hub is circumposed about the actuator means. In one group of embodiments, for example, the hub has a central recess therein, and the actuator means are positioned in the recess.

In certain of the presently preferred embodiments of the invention, the foot is suspended from the jack, but rotatably interengaged with the same so that the jack can be rotated about the axis of the carriage when the foot is engaged with the surface therebelow. In many embodiments, the jack takes the form of a screw jack which is threadedly mounted on the carriage at the axis thereof and has the foot at the bottom thereof. In some of these, a handle is provided at the top of the jack to actuate the same.

Preferably, the hub is adapted to form a platform at the top thereof, on which an additional carrier may be rested when desired. In certain presently preferred embodiments of the invention, for example, the hub takes the form of a series of posts which are arranged in a circle on the carriage and symmetrically angularly spaced about the axis of the same, to provide such a platform. Furthermore, where the drive means take the form of a screw jack having a handle at the top thereof, the handle is often accommodated within the cage formed by the series of posts.

When a screw jack is used and the foot is interconnected with the jack at the bottom thereof, to be raised and lowered with the jack, the connection between the foot and the jack often includes a thrust bearing interposed therebetween.

BRIEF DESCRIPTION OF THE DRAWINGS

These features will be better understood by reference to the accompanying drawings wherein a presently preferred embodiment of the carrier is illustrated.

In the drawings:

FIG. 1 is a perspective view of the carrier;

FIG. 2 is a top plan view of the same;

FIG. 3 is a side elevational view of the same;

BEST MODE FOR CARRYING OUT THE INVENTION

Figure 4:
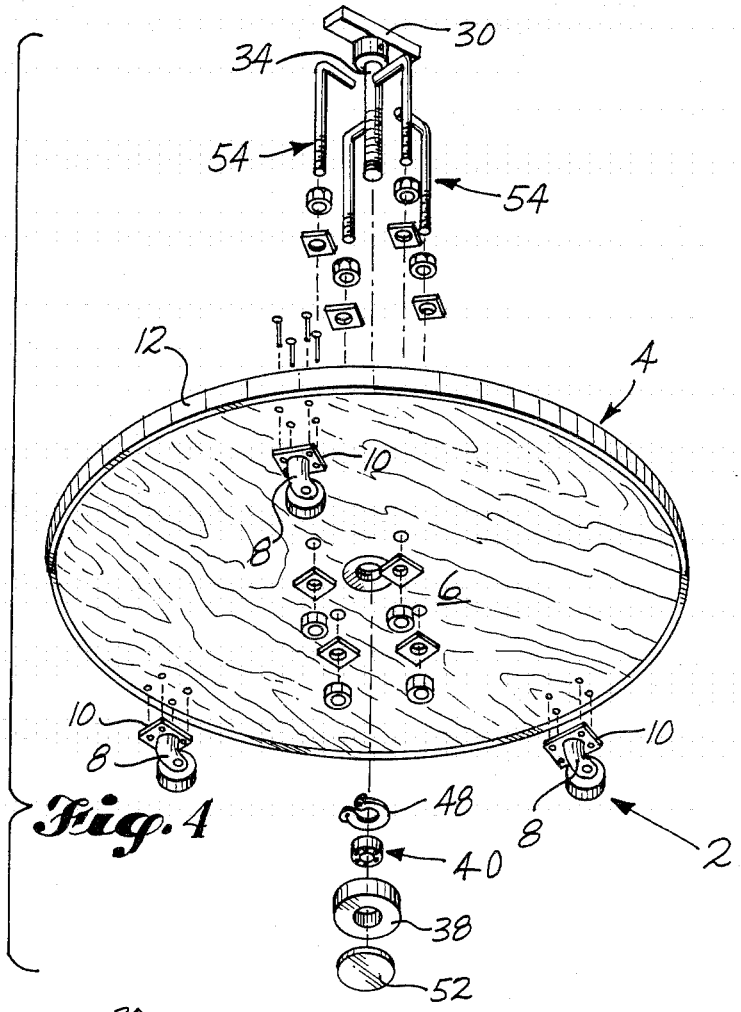
FIG. 4 is an exploded perspective view of the carrier.

Referring to the drawings, it will be seen that the cable carrier 2 comprises a wheeled carriage 4 which is constructed, dolly-like, from a circular disc 6 having a set of casters 8 mounted in swivel blocks 10 on the underside thereof. The disc 6 is of wood laminar construction and has a metal felly or rim 12 thereabout. The casters 8 are bolted to the disc, adjacent the rim 12, and are symmetrically arrayed about the circumference of the carrier. In use, the carrier 2 serves as a mobile support for a coil of electrical cable 14 or the like, which may be used, for example, in outfitting a telephone exchange (not shown). Accordingly, when put to use, the carrier 2 is rested on a horizontal surface 16 and wheeled about on the casters 8 to various sites in the exchange or the like where the cable is required. At each site, the cable 14 is then removed in such lengths as are needed to perform the operation. Before it is removed, however, the carrier 2 is converted to a rotary dispenser from which the coil can be unwound, reel-like, about a journal block 18 fixed in place at the underside thereof, as shall be explained.

Figure 5:
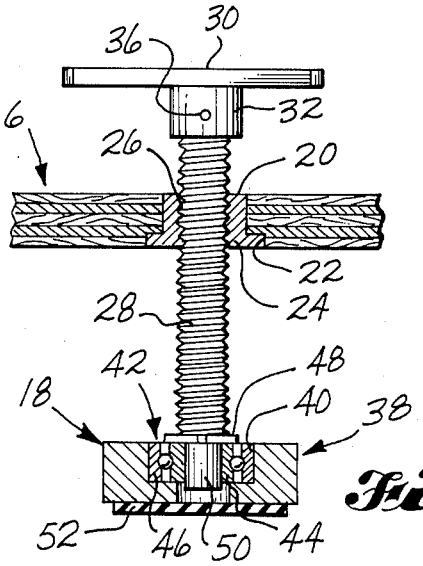
FIG. 5 is a part vertical cross sectional view of the carrier at the central rotational axis thereof.

Referring again to the carrier 2 and FIGS. 3–5 of the same in particular, it will be seen that the disc 6 has a central opening 20 therein which is rabbeted about the lower edge 22 thereof to form a counterbored hole in the carrier for receiving a flanged bushing 24 which has a threaded aperture 26 therein. The bushing 24 serves as a journal for a jack screw 28 which is threadedly engaged upright in the same, and has a flange-like foot 18 at the bottom thereof, and a tee handle 30 at the top thereof. The handle 30 has a depending sleeve 32 and is engaged over a shank 34 at the top of the screw 28, and rigidly secured to the same by means of a pin 36 (FIG. 5) inserted through registering holes (not shown) in the sleeve and shank, respectively. The foot 18 comprises a toroidal plate 38 which is rabbeted at the upper inner peripheral edge 40 thereof to receive a thrust bearing 42 having inner and outer ballbearing-connected races 44 and 46 therein. The inner race 44 is threadedly or otherwise secured by a snap ring 48 to a reduced diameter neck 50 on the bottom of the screw. The outer race 46 is secured to the rabbet 40 of the plate 38. Meanwhile, an elastomeric pad 52 is secured to the bottom of the plate, concentrically thereof, to form a high friction contact surface for the foot.

Circumposed about the screw 28 is a set of L-shaped posts 54 which are inverted and bolted to the carrier in a circle about the screw. The posts 54 are symmetrically arrayed about the screw, moreover, with their laterals 56 angled inward of the circle to form a platform for an additional carrier 2, as shall be explained. Meanwhile, the posts 54 operate as a circular hub about which the coil of cable 14 or the like can be wound on the carrier, and alternatively, unwound from the same when the carrier is converted to a dispensing reel for the cable. This is accomplished by inserting one hand within the cage formed by the posts 54, to grasp the handle 30 of the screw, and using the handle, rotating the screw within the bushing 24 of the carrier until the foot 18 firmly engages the supporting surface 16 therebelow. At this point, the foot 18 becomes a journal block for the carrier, and the journal block enables the carrier to be rotated about the vertical center line thereof on the casters 8.

Should an additional roll of cable 14 be needed, or additional height for the carrier, a second carrier (not shown) can be stacked on top of the carrier shown in the drawings at the platform provided by the laterals 56 of the posts. This feature also makes it possible to store two or more carriers in a compact array of the same.

I claim:

1. carrier for electrical cable or the like, comprising:

a carriage which is raised above a surface therebelow and supported on rotary surface engaging elements, so that it can be shifted in relation to the surface when desired, or rotated about a vertical axis therethrough on the elements, a surface engaging foot which is interposed between the carriage and the surface on the aforesaid axis of the carriage, support means for moveably suspending the foot on the carrier so that the foot can be raised and lowered in relation to the surface on the axis, drive means for raising and lowering the foot along the axis, and means on the carriage defining a raised hub about the axis thereof, which is adapted to have the cable or the like wound thereabout, and alternatively, unwound from the same when the cable is put to use, the drive means and support means being rotatable in relation to the foot, and vice-versa, so that when the foot is engaged with the surface below the carriage, the carriage can be rotated about the axis thereof on the surface engaging elements of the same, to serve as an unwinder for the cable or the like.

2. The carrier according to claim 1 wherein the drive means include a jack which is rotatably mounted on the carriage above the foot and operable to raise and lower the foot relative to the surface.

3. The carrier according to claim 2 wherein the drive means also include actuator means which are connected with the jack and manually operable to cause the jack to raise and lower the foot relative to the surface.

4. The carrier according to claim 3 wherein the actuator means are positioned above the carriage, adjacent the axis of the same, and the hub is circumposed about the actuator means.

5. The carrier according to claim 4 wherein the hub has a central recess therein, and the actuator means are positioned in the recess.

6. The carrier according to claim 2 wherein the foot is suspended from the jack, but rotatably interengaged with the same so that the jack can be rotated about the axis of the carriage when the foot is engaged with the surface therebelow.

7. The carrier according to claim 6 wherein the jack takes the form of a screw jack which is threadedly mounted on the carriage at the axis thereof and has the foot at the bottom thereof.

8. The carrier, according to claim 7 wherein a handle is provided at the top of the jack to actuate the same.

9. The carrier according to claim 1 wherein the hub is adapted to form a platform at the top thereof, on which an additional carrier may be rested when desired.

10. The carrier according to claim 9 wherein the hub takes the form of a series of posts which are arranged in a circle on the carriage and symmetrically angularly spaced about the axis of the same, to provide such a platform.

11. The carrier according to claim 10 wherein the drive means take the form of a screw jack having a handle at the top thereof, and the handle is accommodated within the cage formed by the series of posts.

12. The carrier according to claim 2 wherein the jack takes the form of a screw jack, the foot is interconnected with the jack at the bottom thereof, to be raised and lowered with the jack, and the connection between the foot and the jack includes a thrust bearing interposed therebetween.

* * * * *